United States Patent [19]

Basevi

[11] 4,077,092

[45] Mar. 7, 1978

[54] PIVOTED CLIP

[76] Inventor: John Basevi, Hotel Plaza, Suite 2402, Causeway Bay, Hong Kong

[21] Appl. No.: 795,289

[22] Filed: May 9, 1977

[51] Int. Cl.[2] ..... A44B 21/00

[52] U.S. Cl. ..... 24/81 CC; 24/81 R; 24/137 R

[58] Field of Search ..... 24/81 R, 81 SC, 81 C, 24/81 CC, 137 R, 137 A, 248 R, 252 R

[56] References Cited

U.S. PATENT DOCUMENTS

| | | | |
|---|---|---|---|
| 884,680 | 4/1908 | Polakoskey | 24/137 A |
| 2,456,409 | 12/1948 | Grewe | 24/137 R |
| 2,542,224 | 2/1951 | Werner et al. | 24/137 R |
| 3,041,696 | 7/1962 | Ferri, Jr. | 24/137 A |
| 3,084,410 | 4/1963 | Paul, Jr. | 24/137 A |
| 3,137,906 | 6/1964 | Rob | 24/137 A |
| 3,349,453 | 10/1967 | Iida et al. | 24/252 R |
| 3,593,386 | 7/1971 | Hug | 24/137 R |

*Primary Examiner*—Werner H. Schroeder
*Assistant Examiner*—Moshe I. Cohen
*Attorney, Agent, or Firm*—Kirschstein, Kirschstein, Ottinger, Frank & Cobrin

[57] ABSTRACT

A double-ended clip such as clothes pins, paper clips and the like including two elongated arms between which a floating elastically resilient fulcrum rides in a direction longitudinally of the arms. As the pin is manipulated the fulcrum snaps away from the closing end of the pin and in so doing snaps together the tips of the arms at this end.

16 Claims, 12 Drawing Figures

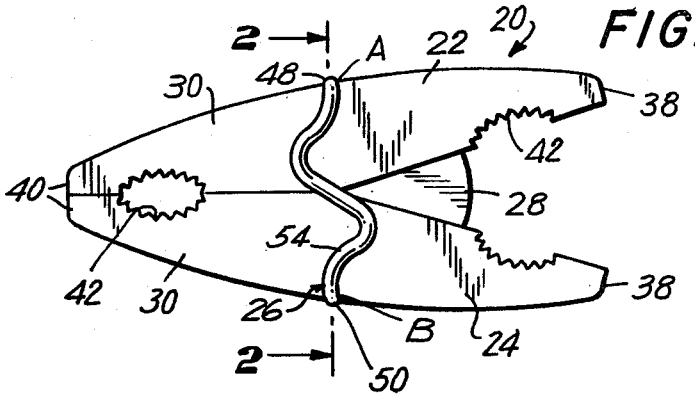
FIG. 1
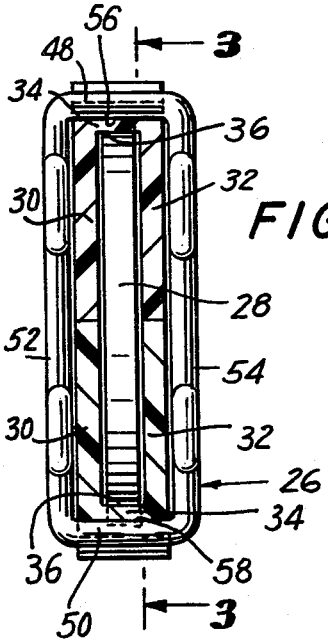
FIG. 2
FIG. 3
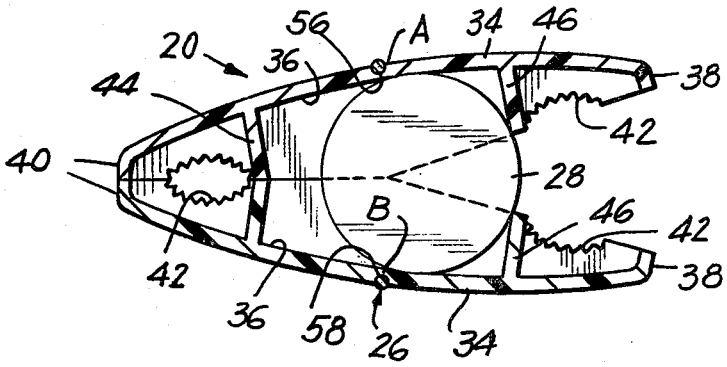
FIG. 4
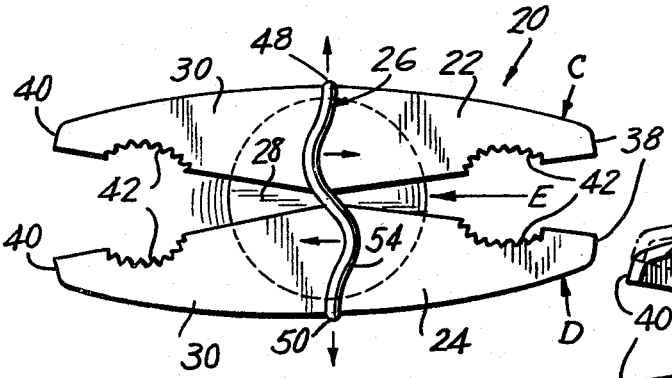
FIG. 5
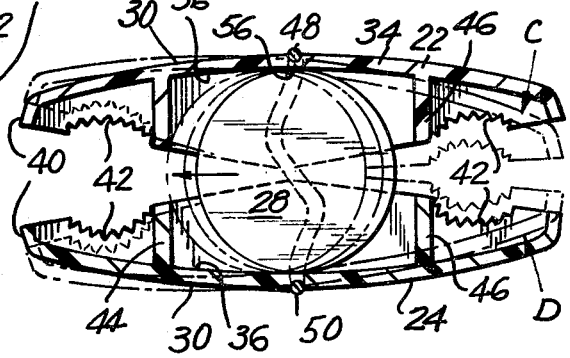

PIVOTED CLIP

BACKGROUND OF THE INVENTION

1. Field of the Invention

Clothes pins, paper clips and the like.

2. Description of the Prior Art

Conventional clothes pins and clips include a pair of arms that can be spread apart about a fixed point adjacent a resilient closing force. The only pin of which the inventor is aware in which the pivot is not fixed is that shown in U.S. Pat. No. 884,680 wherein a shiftable pivot does not supply a snap over center action.

SUMMARY OF THE INVENTION

Purposes of the Invention

It is an object of the invention to provide a clip of novel structure which lends itself particularly well to construction from injection molded plastic parts.

It is another object of the invention to provide a clip of a neat and aesthetic appearance which is small, compact and easy to use and manufacture.

Another object of the invention is to provide a clip which is light in weight and can be made rapidly by mass production methods.

It is another object of the invention to provide a clip of the character described which is doubled ended and which when one end is closed causes the other end to open.

It is another object of the invention to provide a clip having a snap, over center closing action.

Brief Description of the Invention

The pivoted clip of the present invention distinguishes from prior art pivoted clips in two respects, viz, the fulcrum, i.e., pivot, rides longitudinally of the clip and the fulcrum is resilient, creating what is, in effect, a snap or dead center action as the clip, which is double-ended, moves from a position in which a first end is closed and a second end is open to a position which the first end is open and the second end is closed.

More particularly, the clip includes two elongated arms and means to hold the arms in transverse registration with each other. Each arm is provided with a track. The tracks on the two arms are registered and opposed. The tracks constitute U-shaped slots and open mouths of which face each other. A disc rides in both tracks between two positions. A hinge member is articulatably connected to the two arms at spaced points intermediate the ends of the arms to hold the arms in their registered relationship. The disc can shift between the two tracks from either position to the other position and, in so doing, the disc crosses from either side of the hinge member to the other side of the hinge member. The spacing between the two tracks at the hinge member in either gripping position of the clip is less than the diameter of the disc. The disc member is resilient or the hinge member is resilient or both members are resilient so that, as the disc crosses from either side of the hinge member to the other side of the hinge member, either the disc will compress diametrically on a diameter perpendicular to the length of the clip, or the hinge member will expand. Either action permits the disc to transverse the space between the tracks at the hinge member as the disc shifts from either side of the hinge member to the other side of the hinge member.

If desired, the disc is twinned and the arms are T-shaped in cross-section, with the legs of the T's extending toward each other, with the discs riding on the facing surfaces of the heads of the T's on the opposite sides of the legs of the T's, and with a connecting shank that extends between the centers of the twinned discs located between the base edges of the T's.

When the disc is on a given side of the hinge member, the tips of the arms at the opposite side of the hinge member will be urged together so as to press and thereby grip an article between them; the tips of the arms at the other end of the clip will be spaced apart. When the spaced apart ends of the arms are squeezed together, the tracks will diverge from the end of the clip being squeezed toward the opposite end and thereby force the disc to shift toward the opposite position and, in so doing, to cross the hinge member, this being permitted by the resilient nature of the disc or the hinge member. When the disc crosses the hinge member, it will snap toward the opposite position and thereby cause the formerly open end of the clip to snap closed. The pressure created by the momentarily stressed disc or hinge member creates this snap action and the stress remaining after the disc crosses the hinge member urges the closed tips of the arms together.

BRIEF DESCRIPTION OF THE DRAWINGS

In the accompanying drawings in which are shown various possible embodiments of the invention:

FIG. 1 is a side elevational view of a clip embodying the invention, the clip being illustrated with the left end closed and the right end open;

FIG. 2 is an enlarged sectional view taken substantially along the line 2—2 of FIG. 1;

FIG. 3 is a reduced sectional view taken substantially along the line 3—3 of FIG. 2;

FIG. 4 is a view similar to FIG. 1 but showing the disc in an intermediate position as it is crossing from one side of the hinge member to the other side and with both ends of the clip momentarily open;

FIG. 5 is a sectional view similar to FIG. 3 and showing the arms and the disc in successive positions in order to aid in visualizing changes that occur as a formerly open end of the clip is closing and a formerly closed end of the clip is opening;

PREFERRED EMBODIMENTS OF THE INVENTION

Figure 6:
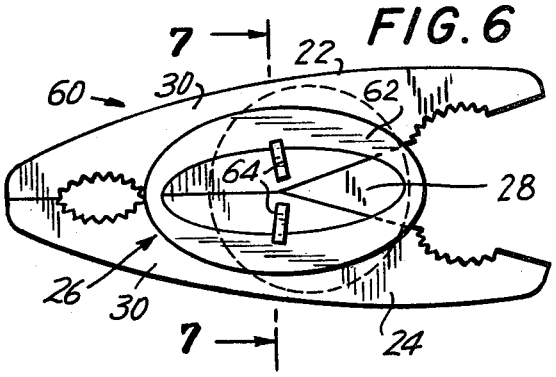
FIG. 6 is a side elevational view of a clip embodying a modified form of the invention and showing an alternate hinge member, the clip being illustrated with the tips of the left ends of the arms closed and those at the right ends of the arms open.

Referring now in detail to the drawings, and more particularly to FIGS. 1–3, the reference numeral 20 denotes a clip constructed in accordance with the present invention. Said clip can be used for all the sundry purposes for which a clip is employed such, for instance, as a clothes pin and a paper clip.

Basically, the clip includes four elements. These are: two arms 22, 24, a hinge member 26, and a disc 28.

The arms 22, 24 are identical to each other. They may be fabricated from any material. However, in a preferred form of the invention the arms are made from a synthetic moldable resin, most conveniently by injection molding. Thus, the arms are rigid, although a degree of flexibility will not impair their operation pursuant to the instant invention, and they are light in weight. Each arm constitutes a pair of flat side walls 30, 32 joined by a base wall 34, thereby forming a slot of U-shaped cross-section which runs the length of the arm, disregarding partitions which later will be described. The slots of the two arms face each other, that is to say, the open mouths of the slots are opposed. The slots are in registration with each other and coextensive, as are the arms. The configuration of the base wall 34 essentially is linear. For the sake of appearance, the base wall may be outwardly convex and inwardly concave. This configuration can be reversed if desired, that is to say, each base wall may be outwardly concave and inwardly convex; or the base wall can be rectilinear. The slots 36 are closed at the tips of the arms by end walls 38, 40. Each arm may be formed with notches 42 near the ends thereof, the notches being provided in both side walls of the arms and being located on that edge of the arm which faces an edge of the opposite arm. Desirably, the notches are roughened as by the use of serrations, as indicated in the figures, to facilitate the gripping action of the clip on an object, e.g., on a clothes line.

Optionally, partitions 44, 46 may interrupt the slot 36 at points spaced from the longitudinal centers of the arms. These slots are included to provide stops for the floating disc 28. However, it has been found in practice that the stops are not absolutely essential and, therefore, the same may be eliminated.

The disc 28 is circular. Its thickness is slightly less than the breadth of the slots 36 in the two arms 22, 24, the difference in these dimensions being sufficient to enable the disc 28 to ride freely in the slots. Too great a difference in dimensions is not desirable inasmuch as it would permit the disc to wobble in the slots and thus create a feeling of instability which would discourage a user from employing the clip. A typical difference in dimensions is one in which the thickness of the disc is about 0.005 inch less than the breadths of the slots.

The disc is received in both of the slots, that is to say, it spans the space between the base walls of the two arms. The disc touches the base walls of both of the arms and rides along both slots, with approximately diametrically opposite portions of the disc being received in the slots. It is desirable to substantially conceal the disc and, for this reason, the heights of the side walls of the two arms are, at their maxima, at approximately the centers of the arms. It will be appreciated as this description proceeds that such heights are not a critical feature of the invention and that the side walls merely need be high enough to retain the disc, i.e., to prevent the disc from slipping out of the arms transversely. The diameter of the disc must be such that the disc will at least contact both base walls at the same time when the clip is assembled by the addition of the hinge member 26, the details of which will be set forth subsequently. To this end, the heights of the side walls must not, when combined, exceed the diameter of the disc. In a preferred form of the invention as shown in FIG. 1, the heights of the two side walls combined are slightly less than the diameter of the disc so that, as shown in FIG. 3, in either gripping position of the clip, the free edges of the side walls of the two arms are close to or touch each other from the hinged member to one end of the clip, the disc at this time being slightly off center and on the side of the hinge member opposite to the side where the free edges of the side walls are in contact or proximity. The disc is rigid and is made from a synthetic plastic. It can be molded or it can be blanked from flat stock.

The hinge member 26 is so constructed that it will articulatably engage the two arms 22, 24 at spaced points intermediate the two ends of the arms. Preferably, the spaced points are at or near the longitudinal centers of the arms. As shown in connection with the clip 20, the spaced points are denoted by the reference characters A and B and are located on the outer sides of the base walls of the arms. The points are spaced apart transversely of the length of the clip, that is to say, there is a gap between these two points A and B which gap extends transversely of the length of the clip. The hinge member 26 is articulatably joined to the arms at said spaced points in such a fashion that the point of connection will not tend to shift longitudinally of the arms. In other words, the points of articulatable connection, i.e., the locations of the points, are fixed with respect to the lengths of the arms.

In accordance with the invention, either the hinge member is resilient, or the disc member is resilient, or both members are resilient. The use of a resilient hinge member, or a resilient disc member, or a resilient hinge member and a resilient disc member, in combination with a disc riding in the slots conjointly provides a floating elastically resilient fulcrum for the two arms 22, 24 which fulcrum rides in a direction longitudinally of the arms.

In the present instance, the disc is rigid; the hinge member is resilient.

In a simplistic form of the invention, the hinge member may constitute a band of elastomeric material encircling the two arms at their centers and seated in notches in the outer surfaces of the base walls of the two arms, the band being under tension. In a more commercially practical form of the invention such as shown in FIG. 1, and wherein the hinge member is resilient, said hinge member constitutes a narrow endless band made of a synthetic plastic material, as by injection molding, and so structured that the band will resiliently yield in a direction transverse to the lengths of the arms 22, 24.

More particularly, the band constituting the hinge member 26 of the clip 20 is rectangular as viewed from the end of the clip and as shown in FIG. 2. The rectangle constitutes a top reach 48 and a bottom reach 50 joined by side reaches 52, 54. The top and bottom reaches are received in notches 56, 58 formed in the base walls of the two arms, these notches anchoring the hinge member against longitudinal movement relative to the arms 22, 24. The side reaches 52, 54 are non-linear. For example, they are of zigzag configuration as shown in FIG. 1. This non-linear configuration permits the side reaches to be extended, i.e., permits the top and bottom reaches to be spread apart against the restoring force exerted by the distorted side reaches when the latter are stretched. The hinge member in the configuration shown in FIGS. 1–3 is molded with the top and bottom reaches closer together than illustrated in these figures; the band is stretched transversely for installation on the clip so that in the clip shown in FIGS. 1, 2 and 3, the top and bottom reaches exert a compressive force on the two arms, tending to squeeze them together.

The assembly of the various components into a clip is quite simple. The two arms 22, 24 are arranged so that the slots 36 face each other and so that the arms are coextensive. Moreover, the tips at one set of ends of the arms are brought into contact with each other and the edges of the arms in which the slots open are engaged from the closed ends to the centers of the arms. Then the band is slid onto the arms starting from the closed ends of the arms toward the centers. As the band approaches the centers of the arms, the top and bottom reaches 48, 50 will engage the base walls of the arms. The band then is pushed further along the arms and is elongated transversely of the arms, tensioning and stretching the side reaches 52, 54. When the top and bottom reaches arrive at the notches 56, 58, they will snap into the notches and thereby stabilize the position of the band. Previous to the time that the two arms are placed in juxtaposition as described above, the disc 28 is inserted in the slots of both arms and is located at an extreme position remote from the touching ends of the arms.

To understand the operation of the clip 20, assume that one end of the clip is closed and the other end is open as shown, for instance, in FIGS. 1 and 3. At this time, the left-hand ends of the arms touch each other. The disc is on the side of the band (hinge member 26) opposite to the side on which the closed tips are located. The band exerts a squeezing force on the centers of the arms. The arms at this moment act as third class levers with a load at the left ends, a force where engaged at an intermediate position by the band, and fulcrums where the disc 28 touches the bases of the slots in the opposed arms. The disc does not touch the bases of the slots at the points A and B where the hinge member engages the arms.

Now let it be assumed that a closing force next is applied to the outer surfaces of the bases of the arms at the right-hand end of the clip as denoted by the reference characters C and D in FIG. 4. As the right-hand ends approach each other and are spaced apart a distance less than the left-hand ends are spaced apart, the bases of the slots which previously were flaring toward the right now start to converge towards the right and flare toward the left. Thereby the bases of the slots start to squeeze the disc at opposite ends of a diameter and urge the disc toward the left as indicated by the arrow E, much as a slippery pit is squeezed by the wet tips of a pair of fingers, causing the pit to be snapped out. Thus, the aforesaid closing forces C, D will urge the disc from its right-hand position shown in FIG. 3 toward a mirror image left-hand position.

As the disc travels from right to left, i.e., from the closing end to the opening end of the clip, the disc passes the hinge member, i.e., passes the centers of the arms. As it does this, the disc will spread (elongate) the hinge member in a direction transverse to the length of the clip. Since the diameter of the disc exceeds the combined heights of the side walls 30, 32 of the arms, the arms will move away from each other in the plane of the band, and thereby the edges of the arms at the open sides of the slots will become spaced apart at the instant that the disc crosses the centers of the arms, this being illustrated in FIG. 4. The same spreading of the arms at such moment is illustrated in solid lines in FIG. 5. The squeezing action aforementioned will cause the disc to travel beyond its central position and progressively further toward the opening end of the clip. After the disc passes the center of the clip, the pressure exerted by the stretched hinge member biases the centers of the arms toward each other and adds to the force urging the disc toward the left. The arms now function as first class levers. Indeed, at this time the forces C, D can be removed and the disc will still move to the left under the force exerted by the tensed band so that the disc tends to snap toward the left and the right hand end of the clip snaps closed. Eventually, the right hand end of the clip closes and the disc reaches a position of equilibrium. This is an extreme left-hand position of the disc, the extreme right-hand position being shown in FIG. 3. These positions, if desired, may be defined by the sundry partitions 46 and abutment of the disc against the same. The extreme left-hand position of the disc is indicated by the dot-and-dash lines in FIG. 5, and an intermediate position between the central position shown infull lines and the extreme left-hand position is shown by the double dot-and-dash line in FIG. 5. Due to the continued movement of the disc after it has passed the center in either direction, the overall effect of the aforesaid structure of the clip results in what may be termed an over-center snap action similar in concept to an over-center toggle.

Figure 7:
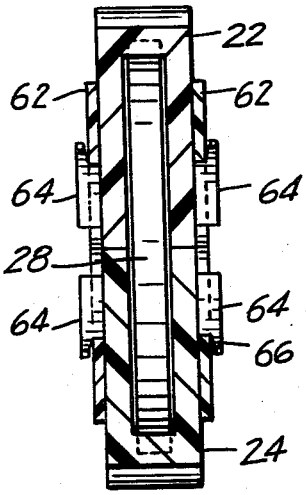
FIG. 7 is an enlarged cross-sectional view taken substantially along the line 7—7 of FIG. 6.
Figure 8:
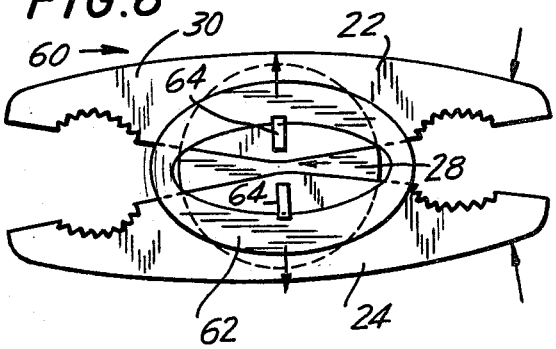
FIG. 8 is a view similar to FIG. 6 but showing the clip at a moment of transition during which the tips at the left sides of the arms are opening and those at the right sides of the arms are closing.

An alternate mechanical arrangement for supplying a hinge member is illustrated in FIGS. 6–8 in connection with a clip 60. The two arms and rigid disc of this clip are denoted by the same reference numerals 22, 24, 28 as those described in the clip 20, the only difference between the two clips being the hinge members 26. The hinge member 26 of the clip 60 constitutes oval bands 62, one on each side of the clip as shown in FIG. 7. The oval bands 62 are elastomeric. Preferably, they are formed, as by molding, from a synthetic plastic, and their resilience is largely due to the configurations of the bands. Each band is flat and is elongated, as is quite clear from FIGS. 6 and 8, in a direction longitudinally of the clip. The bands are sufficiently narrow so that the upper and lower portions thereof can be forced against and, at the same time, said upper and lower portions are bowed to decrease the longitudinal lengths and increase the transverse dimension of the bands.

Each band is secured to its associated side of the clip by a pair of anchor hooks 64 on each side of the band. One hook 64 is in one piece with a side wall 30 of the upper arm 22, and another hook is in one piece with a side wall 30 of the lower arm 24. Each hook has an outwardly facing notch 66, one side of which is defined by the adjacent side wall, a portion of the band being received in the notch. The bands are spread apart at the time that they are assembled to the clip, and the spreading between the bases of the notches is such, after a band has been anchored in the hooks, that the band is in transverse tension so as to exert a compressive force on the arms between the hooks. Since there are bands on both sides of the clip, forces are balanced. The bands 62 function in the same fashion as the endless band constituted by the reaches 48, 50, 52 and 54 of the clip 20.

The operation of the clip 60 is identical to the operation of the clip 20 except for the particular fashion in which the hinge members of the clip 60 are stretched to permit the crossing over of the disc 28 past the centers of the arms 22, 24 as the clip is manipulated.

Figure 9:
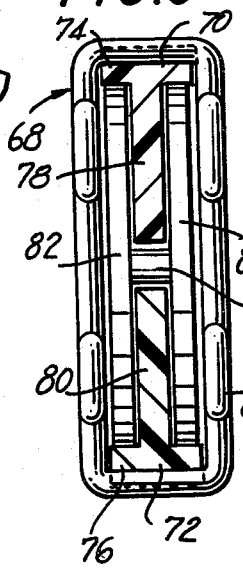
FIG. 9 is a cross-sectional view, similar to FIG. 7, through a clip embodying another modified form of the invention.

In FIG. 9 a third form of clip denoted by the reference numeral 68 is shown. This clip has arms 70, 72 with a form of track different from the form of track described with respect to the arms 22, 24 of the clips 20, 60. Instead of the slots provided in said arms 22, 24, the arms 70, 72 of the clip 68 are of T-shaped cross-section. Specifically each of said arms 70, 72 has a head 74, 76 respectively and a leg 78, 80 respectively. The legs 78, 80 extend toward each other and are in registry. Thereby each arm is fashioned to include a track that constitutes the surface of the head of the T which faces the opposite T and also includes the legs 78, 80. Instead of a single disc such as is employed in the clips 20, 60, the disc of the clip 68 is twinned, that is to say, it consists of two discs 82, 84 interconnected by a stub shaft 86. Each disc is located on a different side of the legs 78, 80. The discs ride on the facing surfaces of the heads 70, 72 with the shaft 86 disposed between the base edges of the legs 78, 80 of the T-shaped arms 70, 72. A resilient hinge member 88 identical to the hinge member 26 is provided and is received in outwardly facing notches in the arms 70, 72.

The operation of the clip 68 is the same as the operation of the clips 20, 60 except that the discs ride on tracks of different configuration.

Figure 10:
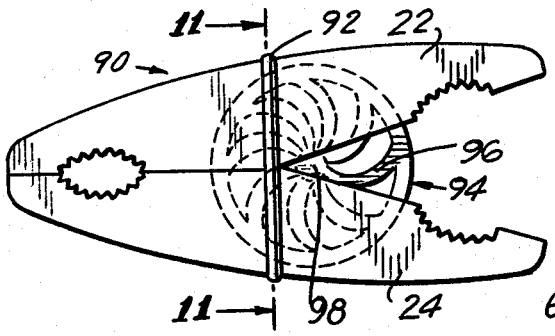
FIG. 10 is a side elevational view of a clip embodying yet another modified form of the invention, this being one in which the disc is resilient in contrast to the discs of the first two described forms of the invention in which the disc is rigid.
Figure 11:
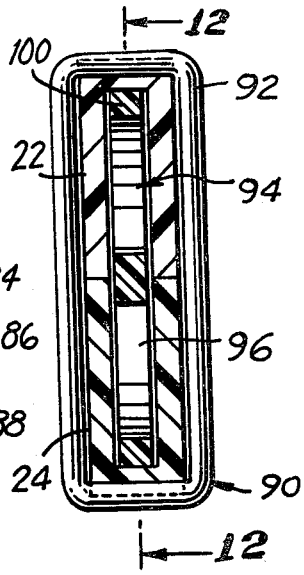
FIG. 11 is an enlarged cross-sectional view taken substantially along the line 11—11 of FIG. 10.
Figure 12:
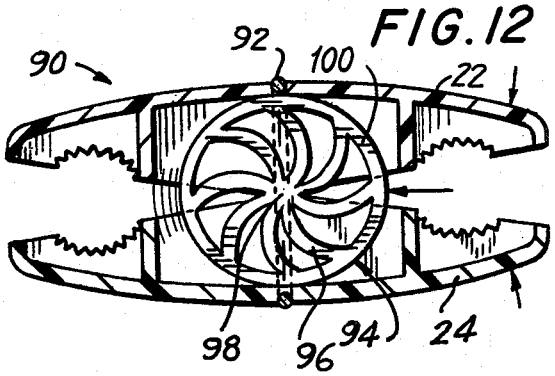
FIG. 12 is a reduced cross-sectional view taken substantially along the line 12—12 of FIG. 11.

In FIGS. 10, 11 and 12 a fourth form of clip denoted by the reference number 90 is shown. This clip has arms 22, 24 identical to the like numbered arms of the clips 20 and 60. However, in this clip the resiliency of the shiftable disc and the hinge member is reveresed. In the clips 20 and 60 the hinge member is resilient and the disc is rigid. In the clip 90 the hinge member denoted by the reference numeral 92 is rigid, and the disc denoted by the reference numeral 94 is resilient.

More particularly, the hinge member 92 is an endless band which encircles the arms 22, 24 and engages them at the notches 56, 58. Said band may be made of metal wire or it may be molded from a synthetic plastic. The vertical reaches of the band are rectilinear so that the band is not stretchable transversely of the arms except to the slight extent which may be desirable for assembly purposes. However, the disc 94, as just observed, is resilient. The disc in its idle position is shown in FIG. 10 where it will be seen to be of circular shape. However, the disc is not solid and, instead, is provided with a plurality of arcuate spokes 96 radiating from a central hub 98. The disc is made of a synthetic plastic. The spokes and rim 100 of the disc are sufficiently thin to permit the same to be readily deformed. The dimensions of the disc in its unstressed condition are the same as the dimensions of the rigid disc 28. However, due to its resilient deformability, the disc 94 can be compressed diametrically.

The operation of the clip 90 is identical, so far as the user is concerned, to the operation of the clip 20 and the clip 60. However, where in the operation of clips 20 and 60 the hinge member 26 expands transversely to permit the disc 28 to cross the centers of the arms, in the operation of the clip 90 the arms do not move apart as the center of the clip is crossed by the disc 94. Instead, the disc 94 compresses diametrically. More specifically, and referring to FIG. 10, if the right-hand ends of the arms 22, 24 which are open in this figure (the left-hand ends are closed) are squeezed together, the arms will pivot about the ends of the hinge member 92 where they are articulatably joined to the arms. This squeezing action will reduce the diameter of the resilient disc 94 and also change the relative angular relationship of the bases of the slots in the arms 22, 24 from a position in which these bases flare outwardly to the right to a position in which these bases converge to the right. This will squeeze the disc toward the left and, at the same time, diametrically compress the disc. The change in relative orientation of the two slots in the arms will squeeze the disc toward the left and, as the disc passes between the upper and lower reaches of the band constituting the hinge member 92, the disc will be compressed further. The disc then will ride out to the left through the hinge member and, as it passes beyond the hinge member, the disc will start to expand rapidly, snapping toward the left until the disc reaches a position on the left-hand side of the clip corresponding mirrorwise to the position originally occupied by the disc, as shown in FIG. 10 on the right-hand side of the clip. In both extreme positions, the disc is slightly off round due to compression between the bases of the slots so that the disc exerts a force acting on the arms to spread the arms wherever the disc is located. In the left-hand gripping position of the clip 90 shown in FIG. 10, each of the arms operates as a first-class lever with the force exerted by the disc separated from the load at the closed ends of the arms by fulcrums where the top and bottom portions of the hinge member band 92 articulatably are connected to the arms 22, 24 at the notches 56, 58. The clip will operate with the same toggle snap action as do the clips 20 and 60.

It will be apparent that, if desired, a resilient disc such as the disc 94 just described can be substituted for the rigid single or twinned disc of any of the clips 20, 60 or 68 above described, in which case the operation of the clip will be a combination of the operations described with respect to the clips 20, 60, 68 on the one hand and the clip 90 on the other hand.

It thus will be seen that there are provided devices wich achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention there is claimed as new and desired to be secured by Letters Patent:

1. A pivoted clip comprising

A. a pair of elongated arms,

I. said arms being transversely registered with a surface of each arm facing a surface of the other arm, II. each arm having a track on the surface thereof facing the opposite arm, a. said tracks being in registry, and B. a floating resilient fulcrum interconnecting said arms, I. said fulcrum including a disc member between said arms and having diametrically opposite portions riding on said track, and II. a hinge member articulatably connected to both said arms at points adjacent to longitudinal centers thereof, a. said points being spaced apart transversely of the lengths of said arms, III. at least one of said members being resilient, IV. the space between the surface of the track on which the disc rides adjacent the hinge member being less than the diameter of the disc when the tips of the arms at either end of the clip are closed and the tips of the arms at the other end of the arms are spaced apart, V. whereby when a pair of spaced tips at either end of the arms are urged by an external force together the disc will shift from one side of the hinge member where the tips are spaced, increasing the outward force exerted on said surface of the tracks as the disc crosses the hinge member, and the disc will snap toward the other side of the hinge member after the disc crosses the hinge member whereby the resilient member will urge together the ends of the arms on the side of the hinge member remote from the disc.

2. A clip as set forth in claim 1 wherein the disc is circular.

3. A clip as set forth in claim 2 wherein the disc is rigid and the hinge member is resiliently expansible in a direction transverse to the arms.

4. A clip as set forth in claim 3 wherein the hinge member is a band encircling the arms adjacent the center thereof.

5. A clip as set forth in claim 4 wherein the reaches constituting the sides of the band are non-rectilinear.

6. A clip as set forth in claim 3 wherein the hinge member constitutes a pair of members that are elongatable transversely of the lengths of the arms.

7. A clip as set forth in claim 6 wherein the arms include anchoring means to which the elongatable members are attached.

8. A clip as set forth in claim 3 wherein the disc increases the space between the slots at the hinge member as the disc crosses the hinge member.

9. A clip as set forth in claim 3 wherein the hinge member constitutes transversely elongatable members located on opposite sides of the arms, and means to anchor said members to both said arms at each side of the clip and at points spaced transversely of the longitudinal axis of the clip.

10. A clip as set forth in claim 9 wherein the anchoring means constitute protuberances on the outer side surfaces of the arms and upwardly and downwardly facing notches in the protuberances, and wherein the hinge members constitute annuli having portions received in the notches.

11. A clip as set forth in claim 1 wherein the disc is resilient.

12. A clip as set forth in claim 11 wherein the disc constitutes a rim, a hub and spokes extending from the rim to the hub.

13. A clip as set forth in claim 12 wherein the spokes are arcuate.

14. A clip as set forth in claim 1 wherein the tracks constitute slots.

15. A clip is set forth in claim 14 wherein a single disc rides in the slots of the arms.

16. A clip as set forth in claim 1 wherein the arms are T-shaped in crossed-section with the heads of the arms substantially parallel and the legs of the extending arms toward each other and in registry and wherein the disc is twinned and includes a shaft extending between the centers thereof the shaft being located between the base edges of the legs, each disc being disposed on a different side of the legs.

* * * * *